US007229308B2

(12) United States Patent
Ishikawa

(10) Patent No.: US 7,229,308 B2
(45) Date of Patent: Jun. 12, 2007

(54) CONNECTOR ASSEMBLING CONSTRUCTION

(75) Inventor: Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/397,471

(22) Filed: Apr. 3, 2006

(65) Prior Publication Data

US 2006/0228920 A1 Oct. 12, 2006

(30) Foreign Application Priority Data

Apr. 6, 2005 (JP) ..... 2005-110184

(51) Int. Cl.
*H01R 13/64* (2006.01)

(52) U.S. Cl. ..... 439/374

(58) Field of Classification Search ..... 439/374, 439/348, 347, 680, 378, 248, 247
See application file for complete search history.

(56) References Cited

U.S. PATENT DOCUMENTS 4,277,135 A * 7/1981 Schrott et al. ..... 385/75
4,820,180 A 4/1989 Mosquera et al.
5,122,070 A * 6/1992 Lebris et al. ..... 439/140
5,605,150 A * 2/1997 Radons et al. ..... 600/300
5,620,329 A 4/1997 Kidd et al.
6,322,389 B1 11/2001 Reese et al.
6,364,536 B1 4/2002 Chen et al.
6,843,677 B2 * 1/2005 Fukuda ..... 439/374
6,878,001 B2 4/2005 Nishide
2003/0182129 A1 9/2003 Ushida et al.
2004/0161961 A1 * 8/2004 Endo ..... 439/374

FOREIGN PATENT DOCUMENTS

DE 100 12 324 A1 10/2001
WO WO 98/58424 12/1998

* cited by examiner

*Primary Examiner*—Phuong Dinh
(74) *Attorney, Agent, or Firm*—Gerald E. Hespos; Anthony J. Casella

(57) ABSTRACT

A connector assembling construction includes a movable connector (20) provided on a module (M) such as an instrument panel of an automotive vehicle and a waiting-side connector (40) provided on a body (B) and having a receptacle (41) for receiving the movable connector (20). The movable connector (20) and the waiting-side connector (40) are connected as the module (M) is assembled with the body (B). Rib-shaped slanted surfaces (28, 30) project within the entire width range and within the entire height range of a connecting surface of the movable connector (20). The slanted surfaces (28, 30) are arranged at positions near opposing ends of the connecting surface, and have gradients to increase projecting amounts thereof as they extend in from the ends of the connecting surface.

10 Claims, 9 Drawing Sheets

CONNECTOR ASSEMBLING CONSTRUCTION

BACKGROUND OF THE INVENTION

1. Field of the Invention

The invention relates to a connector assembling construction for connecting a module-side connector and a body-side connector as a module such as an instrument panel is assembled with a body in an automotive vehicle.

2. Description of the Related Art

Modules, such as an instrument panel, must be assembled with the body of an automotive vehicle. The module and the body have connectors that must be connected with one another as the module and the body are assembled. However, connecting parts of the connectors are hidden between the module and the body and may be displaced from each other during the assembly process. As a result, assembly efficiency may be reduced. U.S. Pat. No. 6,878,001 discloses a connector assembling construction which is designed in view of this problem. The connector assembling construction of U.S. Pat. No. 6,878,001 has a waiting-side connector with a receptacle and a tapered guide is formed at the opening edge of the receptacle to correct a displacement during the connecting operation. According to this assembling construction, the front end of a movable connector contacts the slanted inner surface of the guide during a connecting operation. As a result, the front end of the movable connector moves orthogonal to a connecting direction and into a proper insertion position as the connecting operation progresses.

However, a correctable range is determined by the size of the guide in this construction. Thus, an attempt to miniaturize the guide restricts the correcting displacement, and it is difficult to miniaturize the entire connector.

The invention was developed in view of the above, an object is to miniaturize a connector while correcting displacement during connection.

SUMMARY OF THE INVENTION

The invention relates to a connector assembling construction comprising a first connector to be provided on a module such as an instrument panel of an automotive vehicle and a second connector to be provided on a body. The first and second connectors are connected as the module is assembled with the body. The second connector includes a receptacle for receiving the first connector. Ribs project from a connecting surface of the first connector along at least one of the width and height directions. Slanted surfaces are formed projecting end edges of the ribs for guiding the first connector into the receptacle. The slanted surfaces are near opposing ends of the connecting surface and have gradients so that projecting amounts increase as they extend in from the ends of the connecting surface.

The ribs for correcting displacement are on the connecting surface of the first connector. Thus, a guide at the opening edge of the receptacle can be miniaturized, and the entire connector can be miniaturized.

The ribs for correcting a displacement are on the connecting surface of the movable connector. Thus, a guide at the opening edge of the receptacle can be miniaturized, and the entire connector can be miniaturized.

The ribs preferably extend along both width and height directions. Thus, a displacement in any direction can be corrected.

The ribs extending along the width direction and those extending along the height direction preferably are connected with each other. Thus, the ribs are reinforced against impacts from the outside.

Each rib preferably is formed with pieces peaking at a connected point thereof where projecting amounts are largest and have gradients to gradually decrease the projecting amounts toward their respective ends.

Guiding projections of the first connector preferably are insertable into substantially conforming guiding grooves in the second connector when the two connectors are oriented properly. Thus, an erroneous insertion of the first connector, such as an upside-down insertion, can be avoided.

The first connector is assembled with the module and the second connector is assembled with the body for movement in at least one direction at an angle to a connecting direction of the two connectors.

The ribs preferably can slide in contact with at least one guiding surface on the second connector to guide the first connector into the receptacle.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
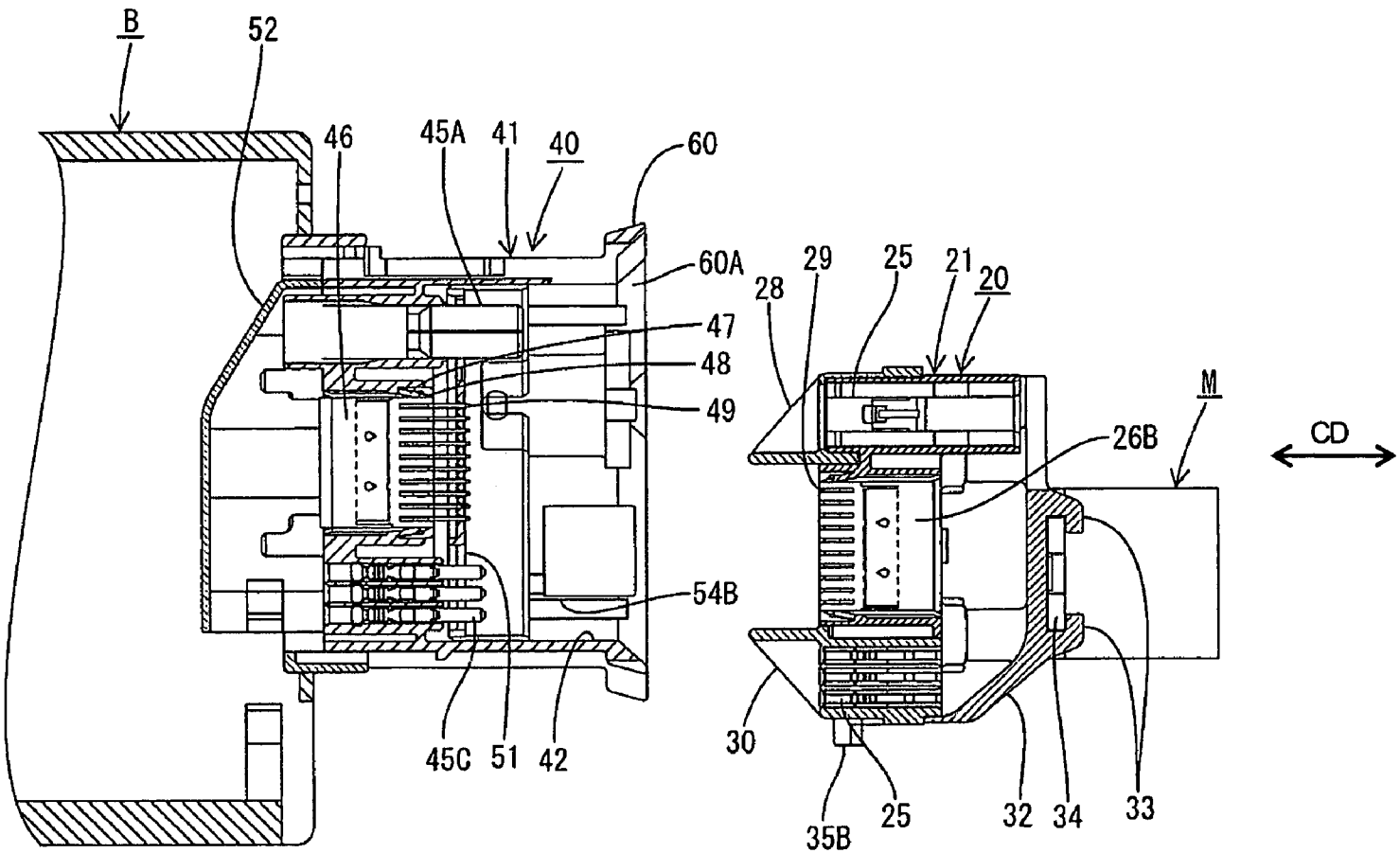
FIG. 1 is a section showing a state before a waiting-side connector and a movable connector are connected in one embodiment of the invention.
Figure 2:
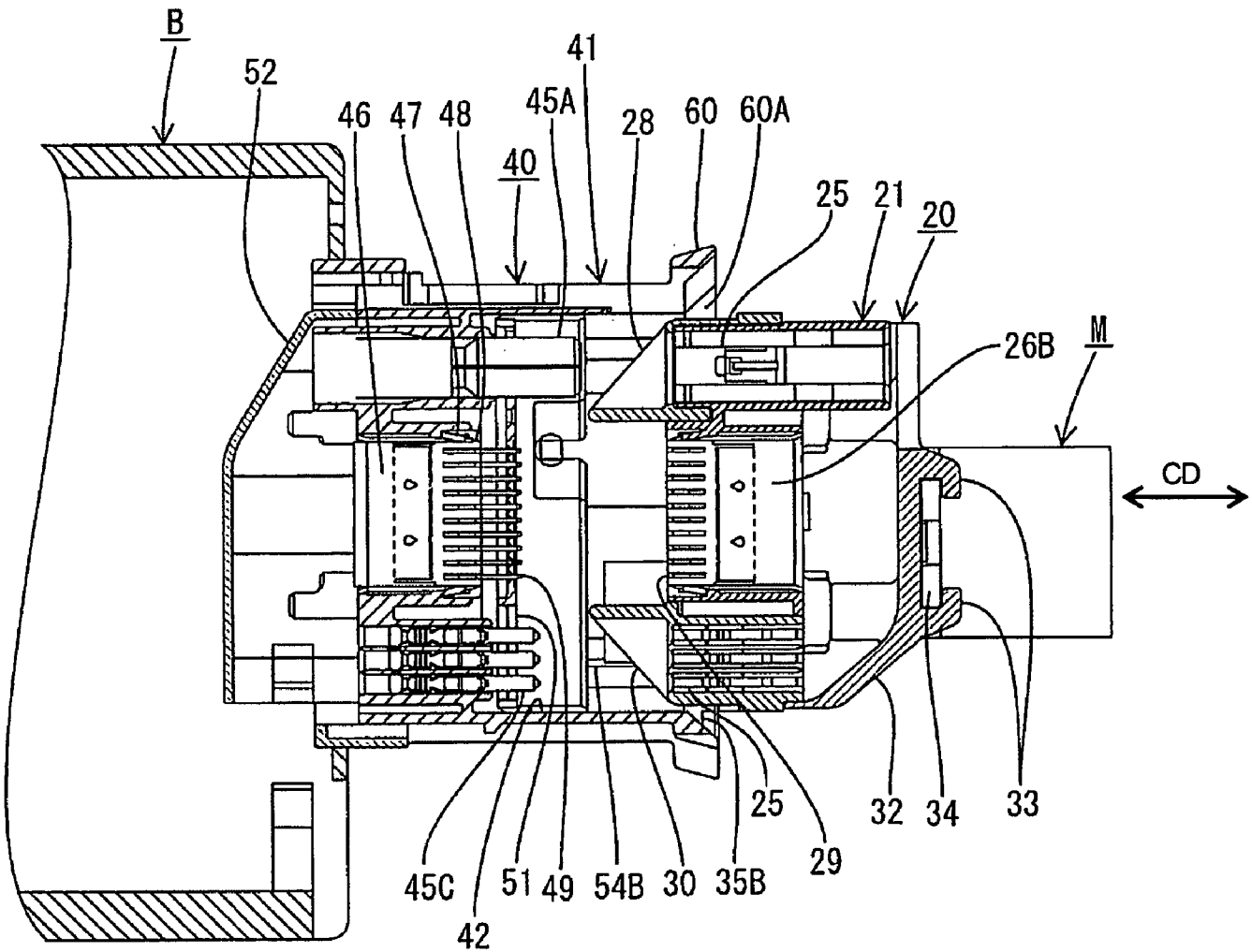
FIG. 2 is a section showing the movable connector corrected to a proper insertion position with respect to the waiting-side connector.
Figure 3:
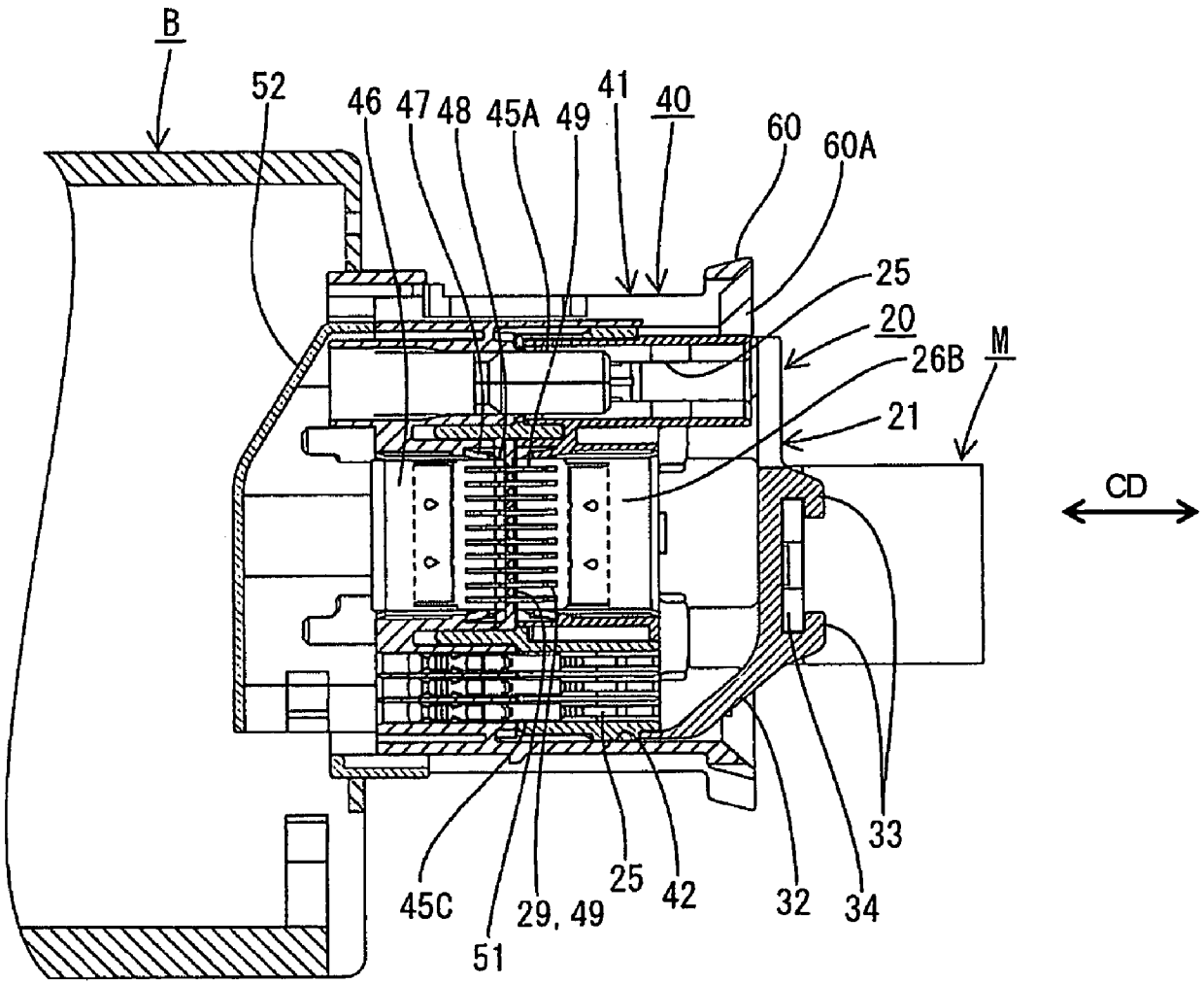
FIG. 3 is a section showing a state where the movable connector is properly connected with the waiting-side connector.
Figure 4:
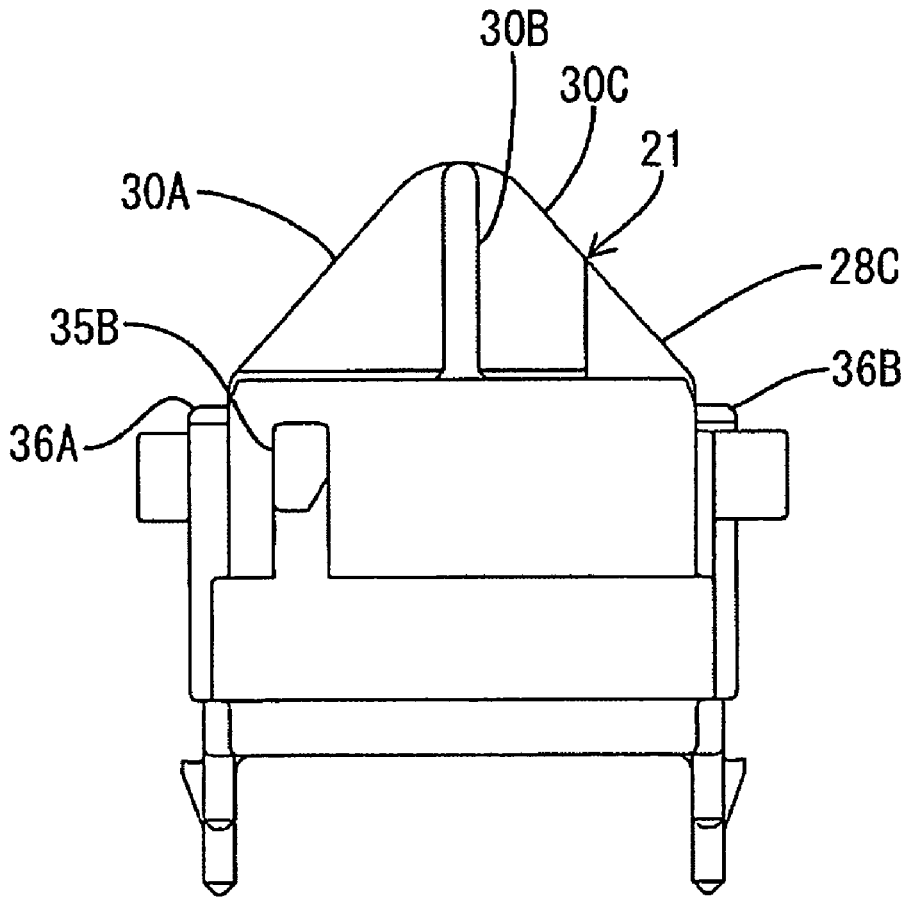
FIG. 4 is a bottom view of a female frame of the movable connector.
Figure 5:
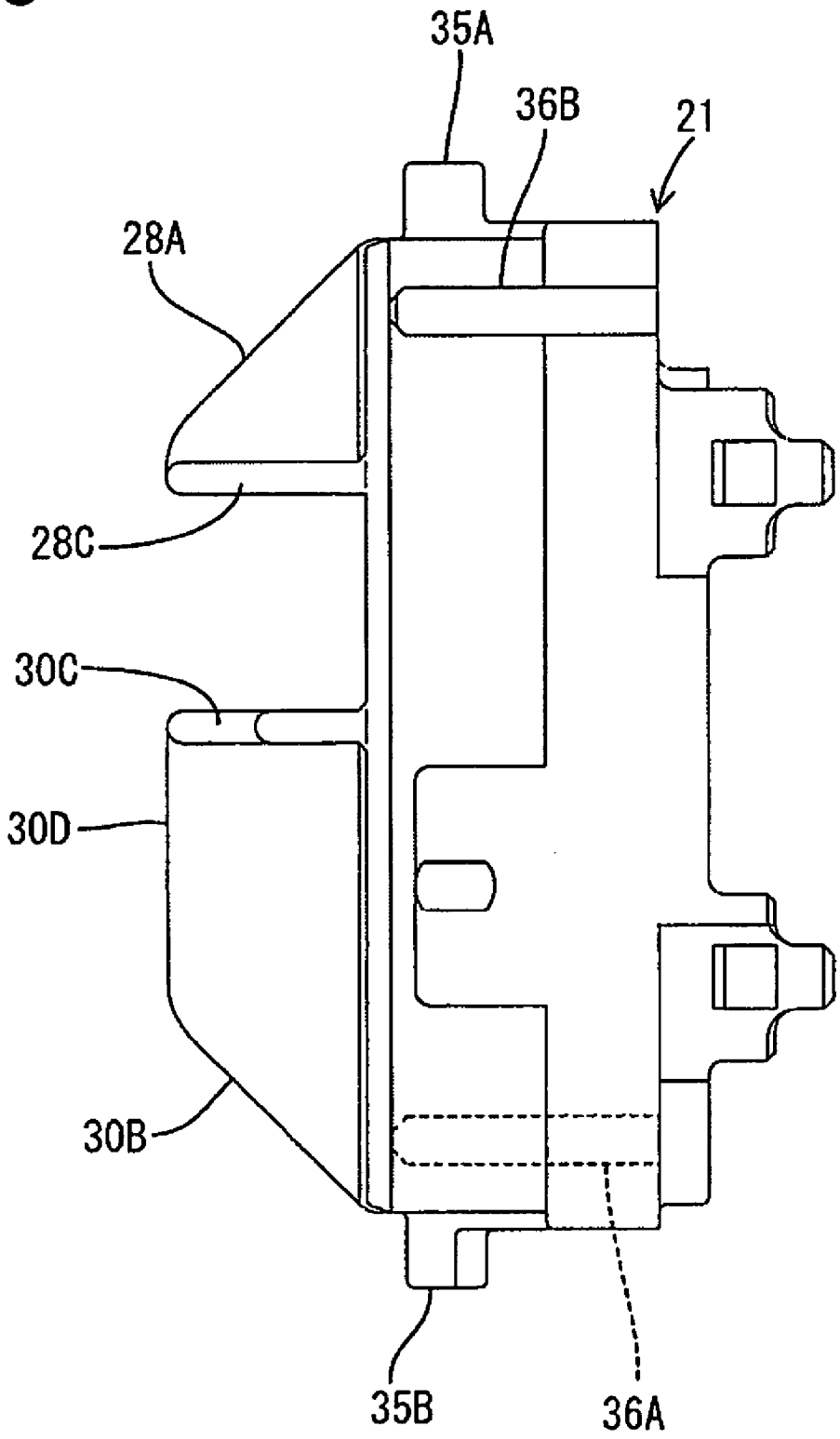
FIG. 5 is a side view of the female frame of the movable connector.

A movable connector according to the invention is identified by the numeral 20 in FIGS. 1 to 9. The movable connector 20 is provided on a module M, such as an instrument panel of an automotive vehicle, and is connectable with a waiting-side connector 40 on a body B as the module M is assembled with the body B. The waiting-side connector 40 is assembled with the body B to be substantially two-dimensionally movable in a mounting plane that is normal to a connecting direction CD of the two connectors 20, 40. In the following description, ends of connectors to be connected are referred to as the front ends, and reference is made to FIGS. 6 and 9 concerning vertical direction VD (height direction HD) and transverse direction TD (width direction WD).

The waiting-side connector 40 has a male frame 41 made e.g. of a synthetic resin. The male frame 41 is a wide block, and a receptacle 42 extends into the front end of the male frame 41. A guide 60 is formed at the front edge of the receptacle 42 to widen an opening of the front end towards the front. A slanted guiding surface 60A is formed at the front inner surface of the receptacle 42 and is inclined with respect to the connecting direction CD. A wire cover 52 is mounted on the rear surface of the male frame 41 to specify draw-out directions of wires connected with male terminal fittings 45 and small-size male terminal fittings 49.

Figure 9:
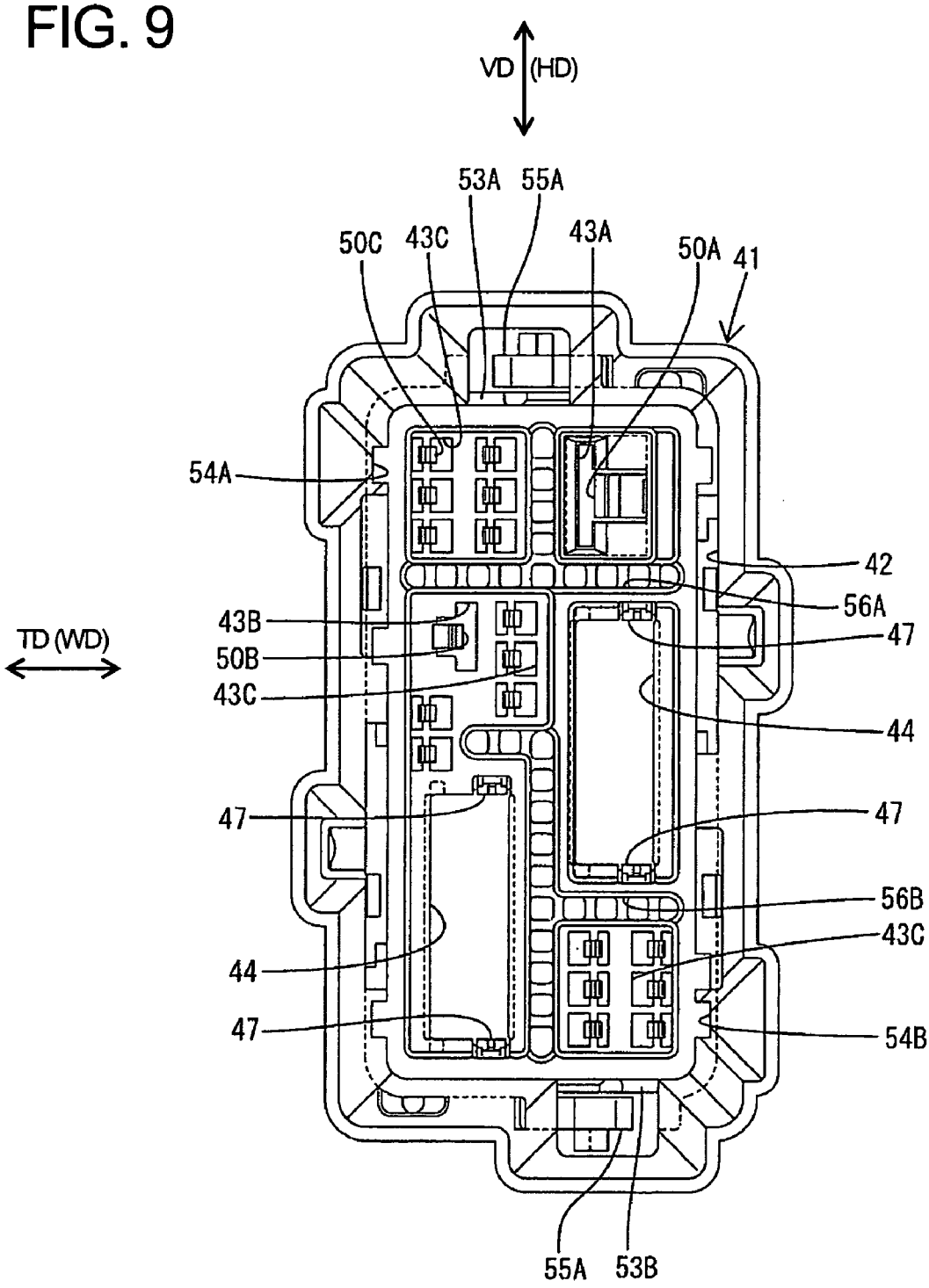
FIG. 9 is a front view of the male frame of the waiting-side connector.

The male frame 41 is formed with one large cavity 43A, one medium cavity 43B and seventeen small cavities 43C, as shown in FIG. 9. Other combinations of large, medium and small cavities 43A–C can be provided, and, for convenience, the cavities are referred to herein collectively by the numeral 43. The male frame 41 also is formed with two accommodating chambers 44. The cavities 43 and the accommodating chambers 44 penetrate the male frame 41 in forward and backward directions along the connecting direction CD. Male terminal fittings 45 can be accommodated in the respective cavities 43, and auxiliary connectors 46 can be accommodated in the respective accommodating chambers 44. More particularly, a large male terminal fitting 45A, a medium terminal fitting (not shown) and small terminal fittings 45C are insertable into the respective cavities 43A, 43B, 43C from behind. Locks 50A, 50B, 50C are formed in the cavities and resiliently engage the male terminal fittings 45 when the male terminal fittings 45 reach proper mount positions.

Retaining pieces 47 are formed at upper and lower positions on the inner surface of each accommodating chamber 44. The retaining pieces 47 engage and retain latches 48 on the auxiliary connectors 46. As shown in FIG. 1, the small male terminal fittings 49 are insertable into the auxiliary connectors 46 from behind so that male tabs project from the front surfaces of the auxiliary connectors 46. The leading ends of the male tabs are positioned by a moving plate 51 that is moved substantially along the connecting direction CD towards the back of the receptacle 42 as the connectors 20, 40 are connected.

The movable connector 20 has a female frame 21 made e.g. of a synthetic resin. The female frame 21 is a wide block, and is insertable into the receptacle 42 of the waiting-side connector 40. At least one first rib 28 and at least one second rib 30 project forward from the front surface of the female frame 21, and a wire cover 32 is mounted on the rear surface of the female frame 21 to specify draw-out directions of wires connected with female terminal fittings 25 and small-size female terminal fittings 29. The wire cover 32 is thicker than the wire cover 52. Additionally, mounting portions 33 are on an outer surface of the wire cover 32 and engage a bracket 34 of the module M from above and below for holding the wire cover 32 on the module M.

Figure 6:
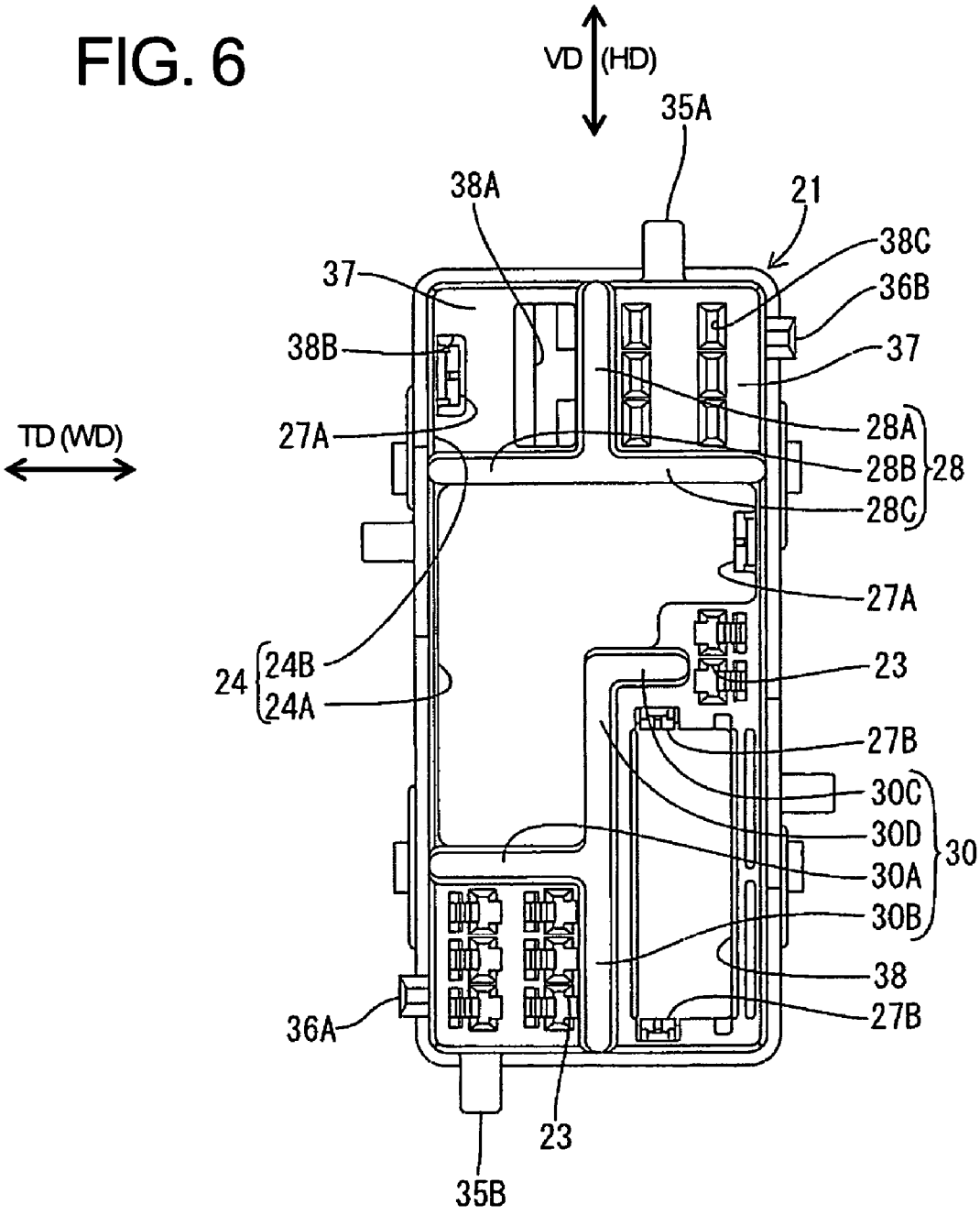
FIG. 6 is a front view of the female frame of the movable connector.
Figure 7:
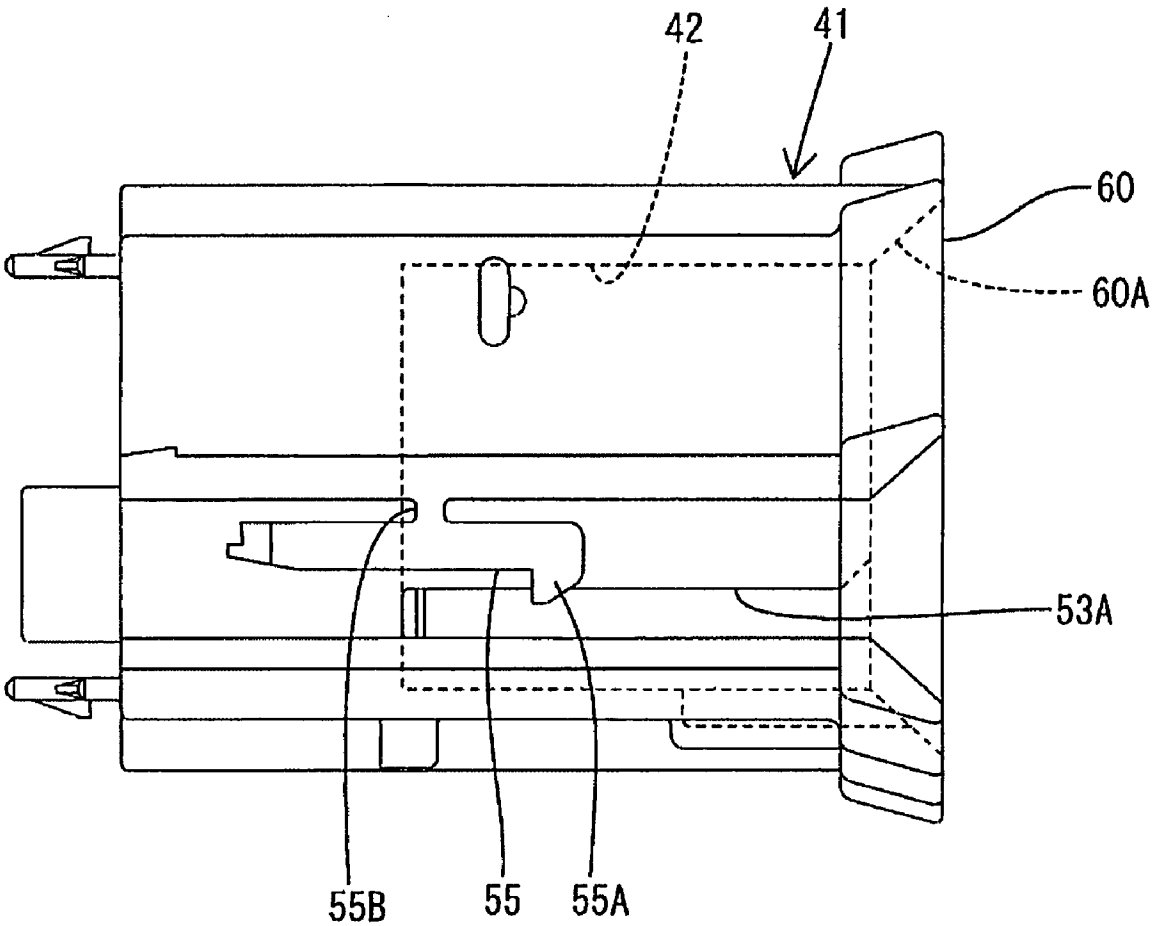
FIG. 7 is a bottom view of a male frame of the waiting-side connector.
Figure 8:
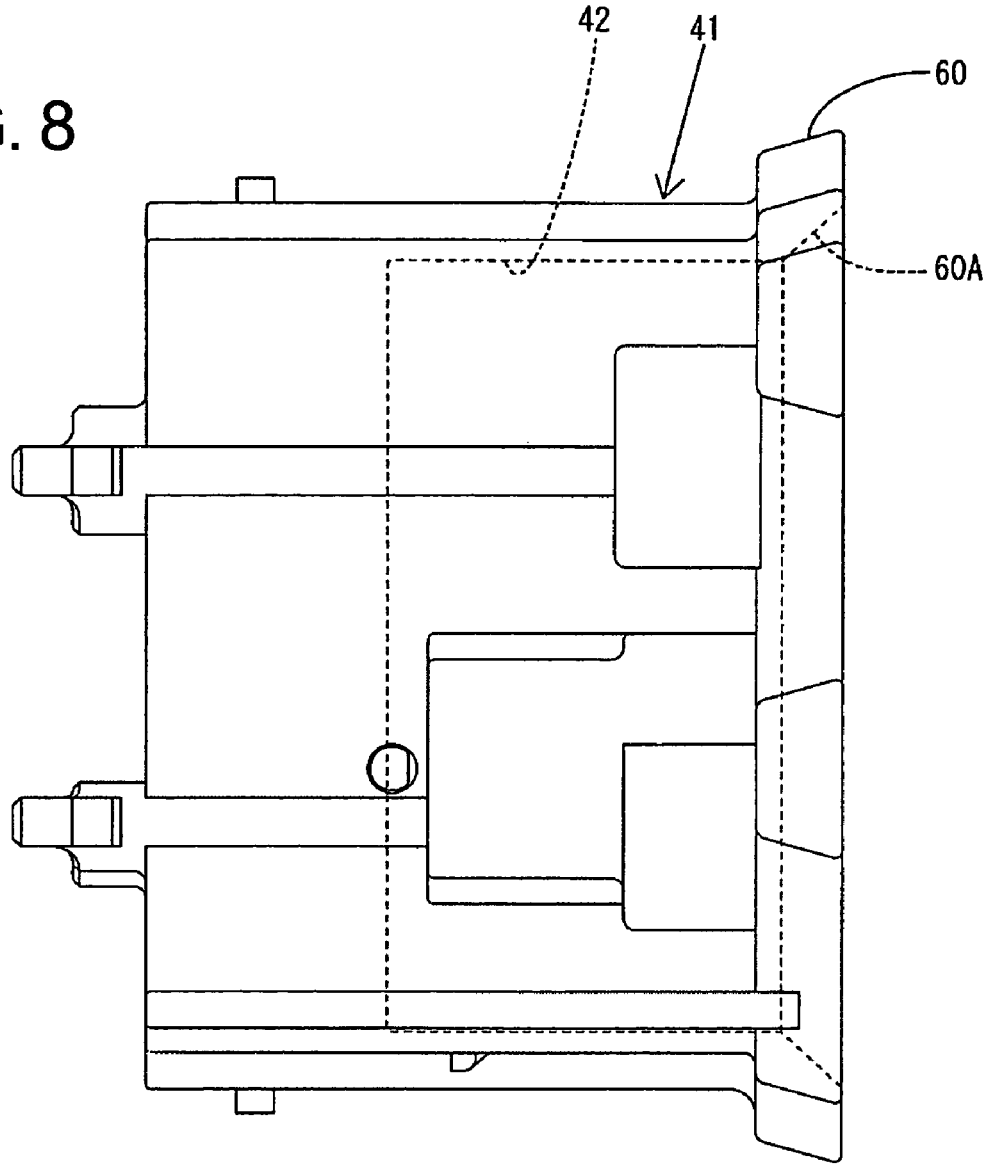
FIG. 8 is a side view of the male frame of the waiting-side connector.

The female frame 21 has small cavities 23, a large accommodating chamber 24 and a small accommodating chamber 38, as shown in FIG. 6. A large auxiliary connector 26A and a small auxiliary connector 26B can be accommodated in the accommodating chambers 24, 38, respectively.

The small cavities 23 are arranged at a corner of the female frame 21. The large accommodating chamber 24 is substantially L-shaped and is in a substantially middle part of the female frame 21. More particularly, the large accommodating chamber 24 has an open area 24A that penetrates the female frame 21 in forward and backward directions and a closed area 24B at an upper side of the female frame 21. A front wall 37 covers the front surface of the closed area 24B. The large auxiliary connector 26A is retained in the large accommodating chamber 24 by a first resiliently deformable retaining piece 27A at one side of the open area 24A and a second resiliently deformable retaining piece 27A at the opposite side of the closed area 24B. The front wall 37 has a large opening 38A, a small opening 38C to accommodate the male tabs of the male terminal fittings 45, and a midsize opening 38B to accommodate the retaining pieces 27A.

The small accommodating chamber 38 is disposed at a corner of the female frame 21 and penetrates the female frame 21 in forward and backward directions. Additionally, the small accommodating chamber 38 is configured to accommodate the small auxiliary connector 26B, and extends in an area up to substantially half the height of the female frame 21. Resiliently deformable retaining pieces 27B are at upper and lower positions in the small accommodating chamber 38 for retaining the small auxiliary connector 26B.

Portions of the large auxiliary connector 26A in the open area 24A correspond to the right auxiliary connector 46, the midsize cavity 43B and three small cavities 43C at the right side of the midsize cavity 43B in the waiting-side connector 40. Portions of the large auxiliary connector 26A in the closed area 24B correspond to the large cavity 43A and the six small cavities 43C at the left side in the waiting-side connector 40. Further, the small auxiliary connector 26B in the small accommodating chamber 38 corresponds to the left auxiliary connector 46 of the waiting-side connector 40.

The first ribs 28 and the second ribs 30 are at upper and lower parts of the front surface of the female frame 21. The ribs 28, 30 slide in contact with the guiding surface 60A to guide the movable connector 20 into the receptacle 42 when the connecting operation of the two connectors 20, 40 is started.

As shown in FIG. 6, each of the ribs 28, 30 has at least one transverse piece and at least one vertical piece aligned substantially normal to the transverse piece. More particularly, the first rib 28 has transverse pieces 28B, 28C that extend over substantially the entire width of the female frame 21 at a boundary between the open area 24A and the closed area 24B of the large accommodating chamber 24A. The first rib 28 also has a vertical piece 28A that extends substantially along the height direction HD. One end of the vertical piece 28A is joined unitarily with the inner ends of the transverse pieces 28B, 28C. The other end of the vertical piece 28A reaches the upper edge of the female frame 21. The first rib 28 is formed so that the pieces 28A, 28B, 28C peak at a connection where projecting amounts of the pieces 28A, 28B, 28C are largest. Additionally, the pieces 28A, 28B, 28C have gradients to gradually decrease their projecting amounts towards the respective outer ends. In this embodiment, the pieces 28A, 28B, 28C to have substantially the same gradient, which is substantially equal to the gradient of the guiding surface 60A.

The second rib 30 has vertical pieces 30B, 30D that extend substantially in the height direction HD and along the opening edges of the large and small accommodating chambers 24 and 38 at a section between the large and small accommodating chambers 24 and 38. A first horizontal piece 30C extends transversely from the upper end of the vertical piece 30D and is along a leg of the L-shaped open area 24A of the large accommodating chamber 24. A second horizontal piece 30A extends substantially along the width direction WD along the bottom end of the open area 24A of the large accommodating chamber 24. One end of the second horizontal piece 30A is at a juncture of the vertical pieces 30B, 30D, while the opposite end of the second horizontal piece 30A reaches the left edge of the female frame 21. The pieces 30A, 30B of the second rib 30 peak at a connected point thereof and have gradients to gradually decrease their projecting amounts towards their respective outer ends. The vertical piece 30D of the second rib 30 has substantially the same projecting height as the peak of the pieces 30A and 30B, and the horizontal piece 30C of the second rib 30 inclines down towards the outer end thereof. The pieces 30A, 30B, 30C of the second rib 30 preferably have all have substantially the same gradient, which is equal to the gradient of the first rib 28. Additionally, the projecting heights of the peaks of the first and second ribs 28, 30 are substantially equal.

Guiding projections 35A, 35B and guiding grooves 53A, 53B are provided to detect an upside-down or other improper insertion. More particularly, the guiding projections 35A, 35B are formed at a right portion of the upper surface and at a left portion of the bottom surface of the female frame 21 and function. The guiding grooves 53A, 53B are formed at a left portion of the upper surface and at a right portion of the bottom surface of the male frame 41. The guiding projections 35A, 35B enter guiding grooves 53A, 53B when the female 21 is inserted properly into the male frame 41 along the connecting direction CD of the two connectors 20, 40. However, the guiding projections 35A, 35B do not conform to the guiding grooves 53A, 53B and interfere with the mating frames 21, 41 if the female frame 21 erroneously is inserted into the male frame 41 in an improper posture (e.g. upside down). Therefore, the connection of the male frame 41 and the female frame 21 is not permitted in an improper posture.

Lock arms 55 are provided at positions adjacent to the guiding grooves 53A, 53B on outer surfaces of the male frame 41 extend substantially along the connecting direction CD of the two connectors 20, 40. A hinge 55B extends unitarily from a middle part of each lock arm 55 and functions as a deformation center for the respective lock arm 55. Thus, each lock arm 55 is resiliently deformable like a seesaw in a plane along the outer surface of the male frame 41. A protrusion 55A is at a leading end of each lock arm 55 and projects into the corresponding guiding groove 53A, 53B. Accordingly, the guiding projection 35A, 35B inserted into the guiding groove 53A, 53A can be caught by the protrusion 55A of the lock arm 55.

Guiding projections 36A, 36B are formed at a lower part of the left surface and at an upper part of the right surface of the female frame 21. The guiding projections 36A, 36B are insertable into guiding recesses 54A, 54B that extend along the connecting direction CD of the connectors 20, 40 at an upper part of the left surface and at a lower part of the right surface of the male frame 41 to enable a stable insertion during connection of the connectors 20, 40. On the other hand, escaping grooves 56A, 56B are formed in the back surface of the receptacle 42 of the male frame 41 and can accommodate the first and second ribs 28 and 30 of the female frame 21 when the connectors 20, 40 are connected properly.

The small male terminal fittings 49 are inserted into the auxiliary connectors 46 from behind. The male terminal fittings 45 and the auxiliary connectors 46 then are inserted into the frame 41, and the wire cover 52 is on the rear surface of the frame 41. Thus, the waiting-side connector 40 is in condition for mounting on the body B. Similarly, the female terminal fittings 25 and the small female terminal fittings 29 are inserted into the auxiliary connectors 26A, 26B from behind. The female terminal fittings 25 and the auxiliary connectors 26A, 26B then are inserted into the frame 21 from behind, and the wire cover 32 is mounted on the rear surface of the frame 21. The mounting portion 33 of the movable connector 20 then can be fixed to the bracket 34 of the module M.

The movable connector 20 is connected with the waiting-side connector 40 along the connecting direction CD. The first and second ribs 28 and 30 project from the front surface of the movable connector 20 and gradually increase their projecting amounts toward the inner side from the ends thereof. Thus, even if the two connectors 20, 40 are displaced in a direction transverse to the connecting direction CD, the pieces 28A, 28B, 28C of the first rib 28 and the pieces 30A, 30B, 30C of the second rib 30 slide in contact with the guiding surface 60A. As a result, the displacement is corrected towards the proper insertion position. The first and second ribs 28 and 30 extend substantially along both the vertical direction VD and the transverse direction TD and at an angle to the connecting direction CD. Thus, a displacement in any direction can be corrected substantially to the proper insertion position. Further, the pieces 28A, 30A of the ribs 28, 30 that extend along the vertical direction VD connect perpendicularly with pieces 28B, 28C, 30A, 30C that extend normal to the first direction (e.g. the transverse direction TD). These connections provide protection against impacts given thereto at the time of being guided.

Upside-down or other erroneous insertion of the movable connector 20 can be avoided because the guiding projections 35A, 35B are insertable into the guiding grooves 53A, 53B in the waiting-side connector 40. Further, the movable connector 20 can be connected smoothly with the waiting-side connector 40 by inserting the guiding projecting edges 36A, 36B into the guiding recesses 54A, 54B in the waiting-side connector 40. The guiding projections 35A, 35B contact the protrusions 55A at the leading ends of the lock arms 55 as the connecting operation of the connectors 20, 40 progresses, and are engaged therewith after pushing them away. In this way, the two connectors 20, 40 are locked in their properly connected state. At this time, the first and second ribs 28 and 30 are accommodated in the escaping grooves 56A, 56B in the waiting-side connector 40.

As described above, the guiding function conventionally has been given solely to the waiting-side connector 40. As a result, the waiting-side connector 40 is unavoidable large because it is necessary to ensure a large guiding surface 60A. However, the guiding function is given mostly to the movable connector 20 in this embodiment. Thus, the ribs 28, 30 can be accommodated within the entire height range and the entire width range of the movable connector 20. Accordingly, the guiding portion 60 of the waiting-side connector 40 can be made smaller in this embodiment. Further, the respective pieces 28A, 28B, 28C, 30A, 30B, 30C of the ribs 28, 30 extend along first or second orthogonal directions (e.g. vertical direction VD or transverse direction TD) and are coupled unitarily coupled. Thus, any displacement of vertical or transverse direction can be corrected and the ribs 28, 30 are strong against impacts from the outside.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

A divided connector is described in the foregoing embodiment. However, the invention may be applied to non-divided connectors.

The guiding function is divided between the connectors by forming the guiding surface in the waiting-side connector in the foregoing embodiment. However, the guiding surface may be only in the movable connector.

Terminal fittings of different sizes and/or shapes are provided in each of the connectors described above. However, the connectors may have terminal fittings of substantially the same sizes and/or shapes.

What is claimed is:

1. A connector assembling construction comprising:

a first connector to be provided on a module of an automotive vehicle, the first connector having a front end, a forwardly facing connecting surface rearward of the front end and having an outer periphery, side surfaces extending rearward from the outer periphery of the connecting surface and aligned along a height direction or a width direction;

a second connector to be provided on a body, the second connector including a receptacle for receiving portions the first connector rearward of the connecting surface as the module is assembled with the body; and ribs projecting from the connecting surface to the front end of the first connector and aligned along at least one of the width direction and the height direction, each of the ribs having at least one slanted edges sloping in from the outer periphery of the connecting surface of the first connector to the front end of the first connector for guiding the first connector into the receptacle when the first connector is connected with the second connector.

2. The connector assembling construction of claim 1, wherein the ribs substantially planar.

3. The connector assembling construction of claim 1, wherein the ribs extending along the width direction and the ribs extending along the height direction are connected with each other.

4. The connector assembling construction of claim 1, wherein the ribs peak at a connected point thereof where projecting distances from the connecting surface are largest and have such gradient as to gradually decrease the projecting distances thereof towards the outer periphery.

5. The connector assembling construction of claim 1, wherein the first connector has guiding projections formed on the side surfaces and insertable into substantially conforming guiding grooves formed in the second connector when the two connectors are oriented properly for avoiding erroneous insertion of the first connector.

6. The connector assembling construction of claim 1, wherein the first connector is assembled with the module and the second connector is assembled with the body so that at least one of the connectors can move substantially normal to a connecting direction of the two connectors.

7. The connector assembling construction of claim 1, wherein the ribs are disposed and configured for sliding contact with at least one guiding surface on the second connector to guide the first connector into the receptacle.

8. The connector assembling construction of claim 1, wherein each of the ribs aligned along the height direction is joined at the front end of the first connector to at least one of the ribs aligned along the width direction.

9. The connector assembling construction of claim 1, wherein each of the ribs aligned along the height direction is joined to at least one of the ribs aligned along the width direction along a line extending continuously from the front end of the first connector to the connecting surface thereof.

10. The connector assembling construction of claim 1, wherein at least one of the ribs extends continuously across the connecting surface of the first connector.

* * * * *